US007063443B2

(12) United States Patent
Hsu

(10) Patent No.: US 7,063,443 B2
(45) Date of Patent: Jun. 20, 2006

(54) OUTDOOR WATERTIGHT LAMP

(76) Inventor: Nien-Fu Hsu, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/781,736

(22) Filed: Feb. 20, 2004

(65) Prior Publication Data

US 2005/0185405 A1 Aug. 25, 2005

(51) Int. Cl.
*F21V 29/00* (2006.01)

(52) U.S. Cl. ..... 362/267; 362/363; 362/376

(58) Field of Classification Search ..... 362/267, 362/376, 360–363
See application file for complete search history.

(56) References Cited

U.S. PATENT DOCUMENTS 5,477,441 A * 12/1995 Budnovitch et al. ..... 362/267

* cited by examiner

*Primary Examiner*—Stephen F Husar
(74) *Attorney, Agent, or Firm*—Troxell Law Office, PLLC

(57) ABSTRACT

The present invention relates to an outdoor lamp with an improved watertight mechanism. Its peculiar watertight structure is formed by a lower-cap and an upper-cap, wherein a slope shaped on an anti-water rim of the upper-cap to facilitate rainwater slipping, out of the slope and gravity, directly to the ground. A convex bottom is further formed on the anti-water rim of the upper-cap causing rainwater, being unable to flow inwards cross the convex, to fall directly to the ground, thereby preventing rainwater from streaming to the lower-cap. Combining the slope and convex thereof, rainwater flowing into a joint surface thereby being reduced significantly. Additionally, the joint surface is formed with a two-step structure to curtail capillarity, thereby minimizing rainwater permeating inside to damage the lamp.

6 Claims, 4 Drawing Sheets

OUTDOOR WATERTIGHT LAMP

BACKGROUND OF THE INVENTION (a) Field of the Invention

The present invention relates to an outdoor lamp with an improved watertight mechanism. Its peculiar watertight structure is formed by a lower-cap and an upper-cap, wherein a slope shaped on an anti-water rim of the upper-cap to facilitate rainwater slipping, out of the slope and gravity, directly to the ground. A convex bottom is further formed on the anti-water rim of the upper-cap causing rainwater, being unable to flow inwards cross the convex, to fall directly to the ground, thereby preventing rainwater from streaming to the lower-cap. Combining the slope and convex thereof, rainwater flowing into a joint surface thereby being reduced significantly. Additionally, the joint surface is formed with a two-step structure to minimize capillarity, thereby minimizing rainwater permeating inside.

(b) Description of the Prior Art

The watertight structure of a conventional outdoor lamp is usually constructed with merely a seal between joint surfaces, mostly a single step structure thereon. As a result of capillarity, rainwater permeates through the joint seam damping inside to the detriment of the lamp.

As such, how to invent a product excluding the defects inherent in conventional outdoor lamp is the technical difficulty that the inventor hopes to resolve with the present invention.

SUMMARY OF THE INVENTION

The present invention relates to an outdoor lamp with an improved watertight mechanism. Its peculiar watertight structure is formed by a lower-cap and an upper-cap, wherein a slope shaped on an anti-water rim of the upper-cap to facilitate rainwater slipping, out of the slope and gravity, directly to the ground. A convex bottom is also formed on the anti-water rim of the upper-cap causing rainwater, being unable to flow inwards cross the convex, to fall directly to the ground, thereby preventing rainwater from streaming to the lower-cap. Combining the slope and convex thereof, rainwater flowing into a joint surface thereby being reduced significantly. Additionally, the joint surface is formed with a two-step structure to attenuate capillarity, thereby minimizing rainwater permeating inside.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
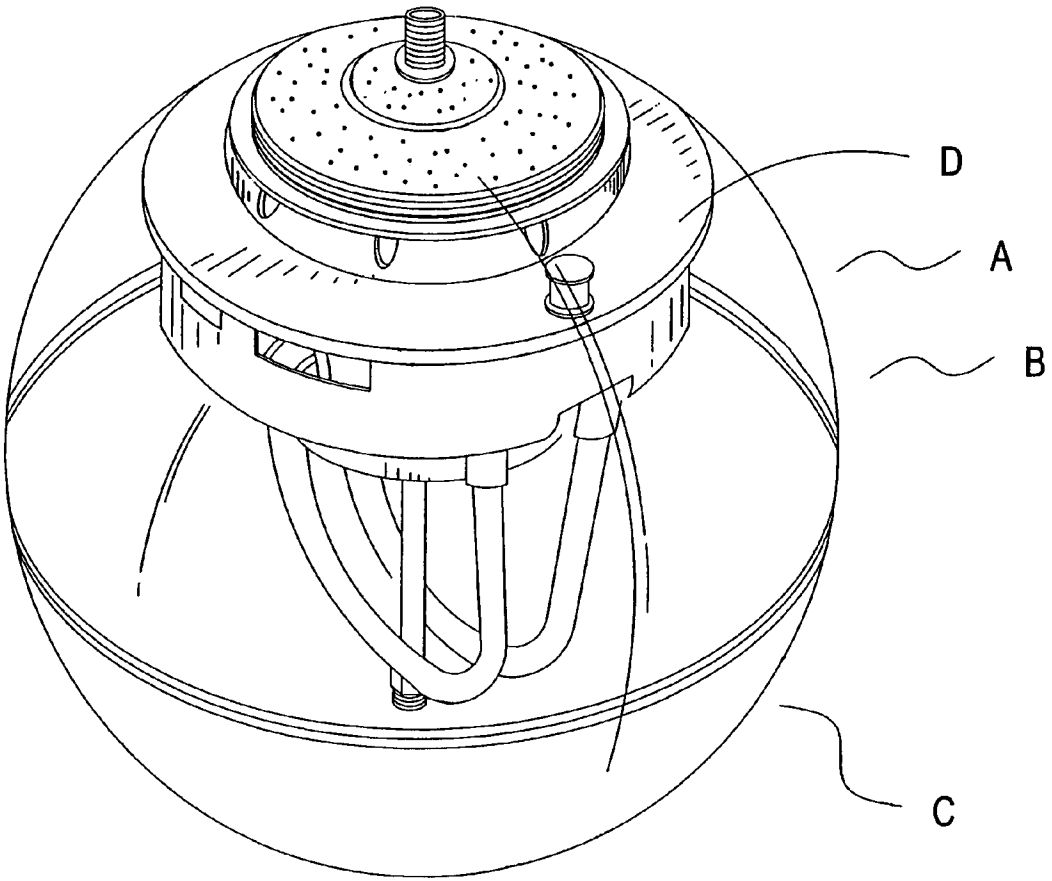
FIG. 1 shows the perspective view of the present invention.
Figure 2:
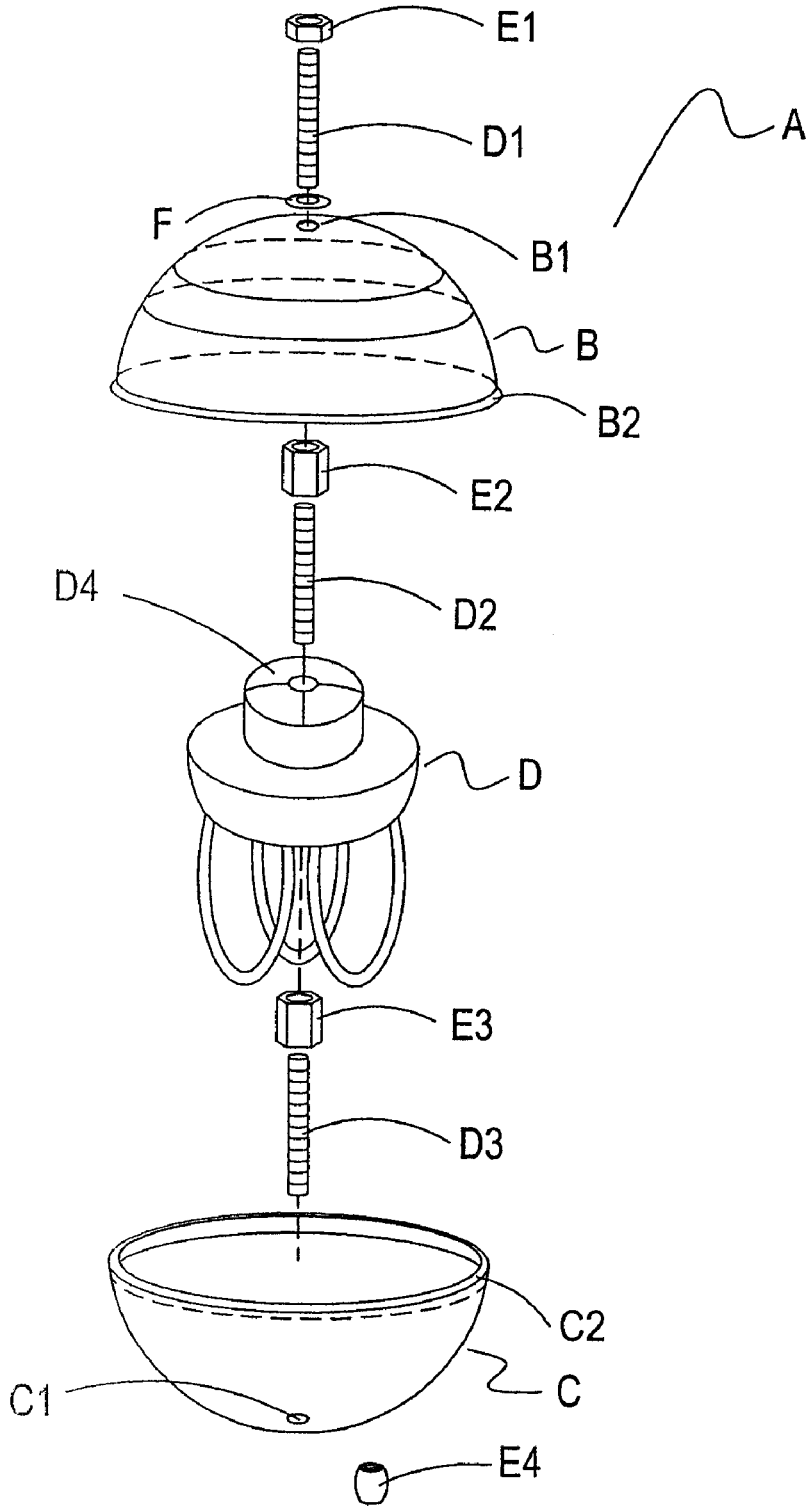
FIG. 2 shows an exploded elevational view of the present invention.
Figure 3:
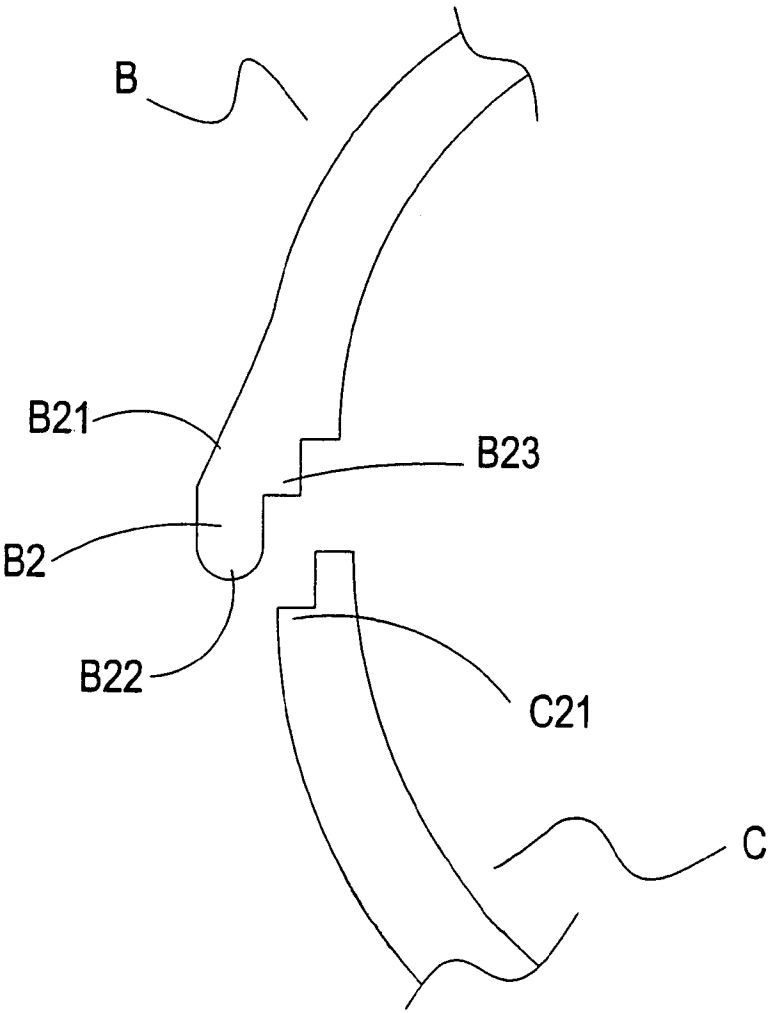
FIG. 3 shows an enlarged cross-section of the joint.
Figure 4:
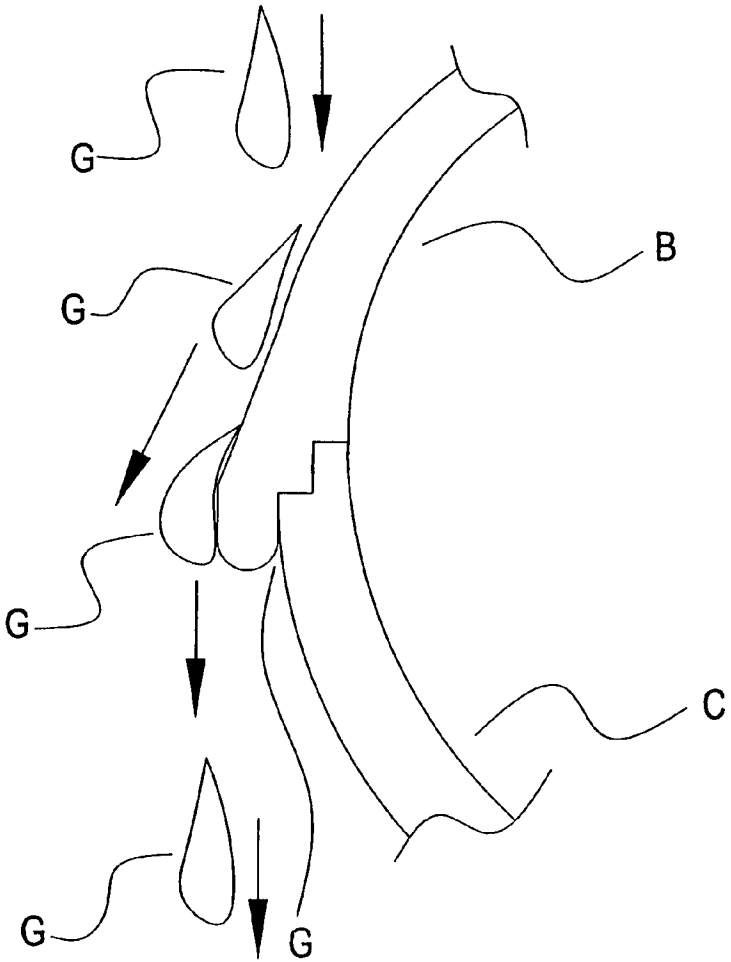
FIG. 4 shows another enlarged cross-section of the joint.

Referring to FIGS. 1~3. The present invention is an outdoor watertight lamp A comprising an upper-cap B including a screw bolt hole B1, an anti-water rim B2, a slope surface B21, a convex B22, and a joint surface B23;

a lower-cap C having a screw bolt hole C1, an anti-water rim C2, and a joint surface C21;

a lamp base D having a screw hole D4;

by assembling screw bolts D2 and D3, with a screw nut E3 penetrating through the screw hole D4 on the lamp base D, and then assembling the screw bolts D1 and D2 with a screw nut E2, wherein the screw bolt D1 penetrating through the screw bolt hole B1 and fastened, through a seal F, by the screw nut E1; likewise, the screw bolt D3 penetrating through the screw bolt hole C1 and fastened, through a seal F, by a screw nut E4;

Referring to FIGS. 3 and 4. Watertight joint made by joining the anti-water rim B2 on the upper-cap B with the anti-water rim C2 on the lower-cap C and by adding a slope B21 on the anti-water rim B2 of the upper-cap B, thereby facilitating rainwater G to glide, out of the slope B21 and gravity, directly to the ground. A convex B22 is further formed on a bottom of the anti-water rim B2 of the upper-cap B, causing rainwater G, being unable to flow inwards cross the convex B22, to fall directly to the ground, thereby preventing rainwater G from streaming to the lower-cap C. Combining the slope B21 and convex B22 thereof, rainwater G flowing into a joint surface B23 and C21 thereby being reduced significantly. Additionally, the joint surface B23 and C21 is formed with a two-step structure to minimize capillarity, thereby barricading rainwater G permeating inside the lamp A to the detriment of the lamp base D.

To reveal in more detail in present invention's advancement and practicality, a summary is given below, Disadvantage of a conventional outdoor lamp:

1. Rainwater permeates through the joint seam causing a moisture environment inside to the detriment of the lamp.

Advantages of the present invention:

1. A multi-step structure is formed on the joint surface of the upper-cap and lower-cap, thereby preventing rainwater from permeating inside;
2. A convex is formed outside the joint surface preventing rainwater from flowing inwards, thereby enhancing watertight performance.
3. Advancement and practicality.
4. Enhancing industry competitiveness.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An outdoor water tight lamp comprising:

a) an upper cap having an upper cap sealing rim having:

i) an exterior sloped surface protruding outwardly from an outer periphery thereof;

ii) an upper cap joint surface located around an inner periphery thereof; and iii) a convex portion located between the exterior sloped surface and the upper cap joint surface;

b) a lower cap having an lower cap sealing rim having a lower cap joint surface located around an inner periphery thereof and engaging the upper cap joint surface and creating a water tight seal there between; and c) a lamp base connected to the upper cap and the lower cap and located there between.

2. The outdoor water tight lamp according to claim 1, wherein the lamp base is connected to the upper cap and the lower cap by a plurality of screws, a plurality of nuts, and at least one seal.

3. The outdoor water tight lamp according to claim 1, wherein the upper cap joint surface is a multi-step structure.

4. The outdoor water tight lamp according to claim 1, wherein the lower cap joint surface is a multi-step structure.

5. The outdoor water tight lamp according to claim 1, wherein the upper cap has an upper cap screw bolt hole in a center thereof, the lower cap has an lower cap screw bolt hole in a center thereof.

6. The outdoor water tight lamp according to claim 5, wherein the lamp base is connected to the upper cap screw bolt hole and the lower cap screw bolt hole by a plurality of screws, a plurality of nuts, and at least one seal.

* * * * *